US006205899B1

(12) United States Patent
Blümle et al.

(10) Patent No.: US 6,205,899 B1
(45) Date of Patent: Mar. 27, 2001

(54) ROTATABLE KNIFE ROLL

(75) Inventors: Martin Blümle, Horhausen; Reinhard Raueiser, Müden, both of (DE)

(73) Assignee: Winkler+Dünnebier Aktiengesellschaft, Neuwied (DE)

( * ) Notice: Subject to any disclaimer, the term of this patent is extended or adjusted under 35 U.S.C. 154(b) by 0 days.

(21) Appl. No.: 09/394,258

(22) Filed: Sep. 10, 1999

(30) Foreign Application Priority Data

Sep. 12, 1998 (DE) ..... 198 41 834

(51) Int. Cl.[7] ..... B26D 7/18
(52) U.S. Cl. ..... 83/98; 83/100; 83/911
(58) Field of Search ..... 83/100, 98, 99, 83/451, 911

(56) References Cited

U.S. PATENT DOCUMENTS

| | | | | |
|---|---|---|---|---|
| 3,103,842 | * | 9/1963 | Winkler et al. | 83/99 |
| 3,172,321 | | 3/1965 | Schrader | 83/100 |
| 3,274,871 | * | 9/1966 | Ehlscheid | 83/99 |
| 3,903,768 | * | 9/1975 | Amberg et al. | 83/100 |
| 4,537,588 | | 8/1985 | Ehlscheid et al. | 83/98 |
| 4,671,152 | * | 6/1987 | Blumle | 83/100 |
| 4,823,659 | * | 4/1989 | Falasconi | 83/100 |
| 5,109,741 | * | 5/1992 | Fuchs | 83/100 |
| 5,575,187 | * | 11/1996 | Dieterlen | 83/98 |
| 5,782,156 | * | 7/1998 | Collins | 83/100 |
| 5,979,279 | * | 11/1999 | Matsumoto et al. | 83/99 |
| 6,026,725 | * | 2/2000 | Okonski | 83/100 |

FOREIGN PATENT DOCUMENTS

| | | |
|---|---|---|
| 21 23 243 | 11/1972 | (DE) . |
| 26 07 812 | 9/1976 | (DE) . |
| 37 30 810 | 3/1989 | (DE) . |
| 0 436 142 | 10/1991 | (EP) . |
| 1 569 124 | 6/1980 | (GB) . |
| 2 123 737 | 2/1984 | (GB) . |
| 2 179 885 | 3/1987 | (GB) . |
| WO95/17286 | 6/1995 | (WO) . |

* cited by examiner

*Primary Examiner*—Kenneth E. Peterson
*Assistant Examiner*—Stephen Choi
(74) *Attorney, Agent, or Firm*—Collard & Roe, P.C.

(57) ABSTRACT

A rotatable knife roll with at least one foil knife secured on a portion of the body of the roll and having a sharp and endless cutting edge closed within itself to cut out window openings. There are breakthroughs for suction apertures arranged within the cutting edge. There is at least one suction-air control valve arranged on the face side of the roll body. The valve is rotatable relative to this portion of the roll. The suction-air control valve has at least one suction-air-control channel and at least one fresh-air channel. There are suction apertures for temporarily retaining a letter envelope blank over a suction and transport angle zone α, and for retaining a piece of material cut out by the foil knife across a suction and transport angle zone β. The suction apertures are arranged in rows to which suction channels are allocated in the part of the roll body. The suction apertures are connected with the suction-air control channel and the fresh-air channel by the suction channels for conducting air. A 3/3-way valve is associated with the suction channel upstream of the suction-air control valve, with an open position for each suction and transport angle zones α, β, and one common closing position for suction and transport angle zones α and β.

8 Claims, 8 Drawing Sheets

FIG. 7
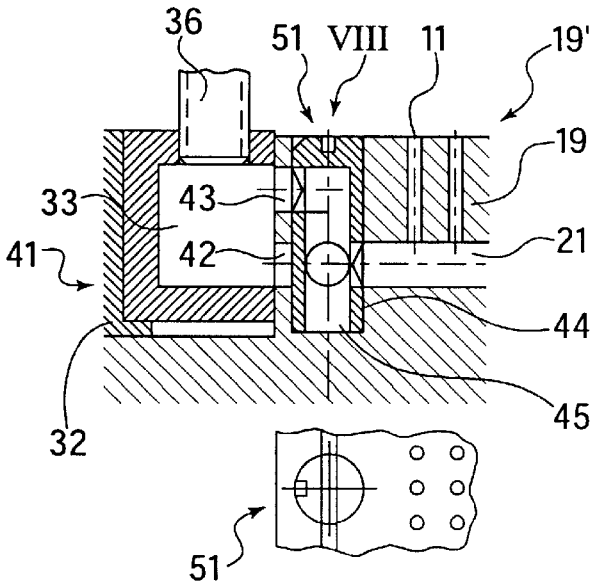
FIG. 8
FIG. 11
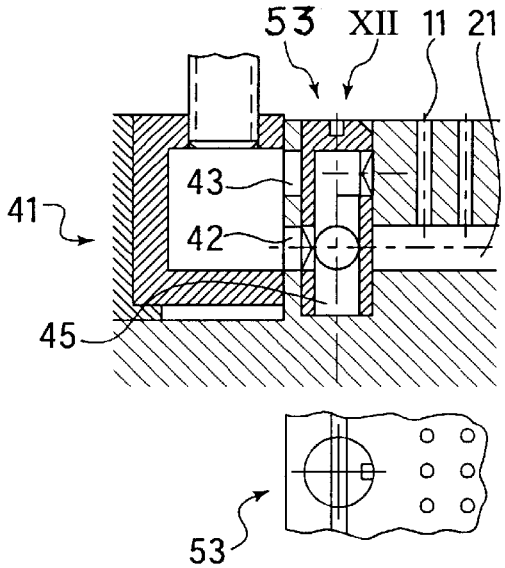
FIG. 12
FIG. 9
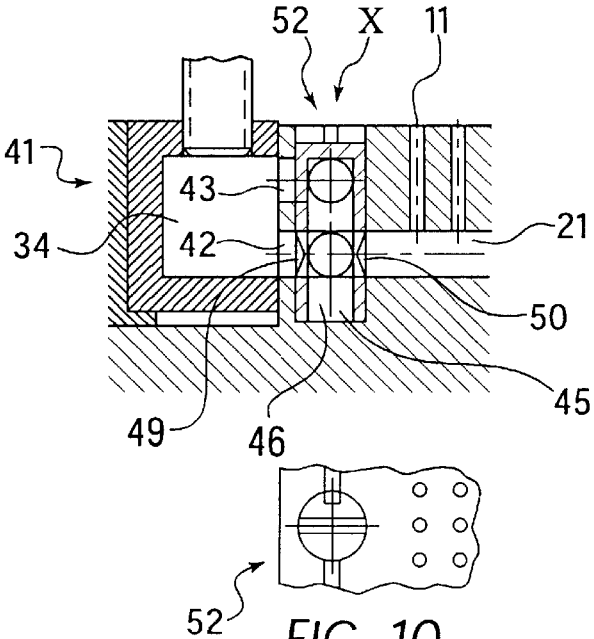
FIG. 10

ROTATABLE KNIFE ROLL

BACKGROUND OF THE INVENTION

1. Field of the Invention

This invention relates to a knife roll for cutting windows out of window envelope blanks.

2. The Prior Art

Such a knife roll is known from U.S. Pat. No. 4,537,588, which shows a knife roll for cutting out the window in window letter envelopes. As the envelope blank is transported with the knife roll, the waste produced by cutting out the window must be retained for a certain time before discharge into a waste hopper. This is accomplished by an axially aligned, single row of suction apertures feeding near the roll surface enclosed by the foil knives. There is another axially extending row of suction apertures in the surface of the roll, which is connected with its own suction* air control channel in the carrier shaft.

However, the row of suction apertures is located in the direction of rotation of the knife roll in front of the knives, and temporarily retains the front edge of the envelope blank on the surface of the roll. Only one single window can be cut out with the cutting roll, and the waste can then be carried along by the knife (or cutting) roll to a discharge point following in the circumferential direction. Furthermore, only one defined size of blanks can be processed, where the spacing of the window from the front edge of the blank is within a comparatively narrow range.

U.S. Pat. No. 3,172,321 discloses a counter roll cooperating with a cutting roll for cutting out windows. The counter roll transports the letter envelope blanks to be provided with windows past the cutting roll. For this purpose, the counter roll has several axially extending rows of suction holes arranged one after the other, with each hole circumferentially spaced from each other. A vacuum can be selectively admitted to the suction holes via a carrier shaft with two axial control channels for suction air. Each channel is communicatively connected via substantially radial channels with an axial distribution channel in the circumferential surface of the carrier shaft. A cup-shaped ring sector having rows of suction holes is supported on the carrier shaft and can be rotated and fixed versus the carrier shaft so that two neighboring rows of holes can be selectively connected with distributing grooves and thus with the suction-air control channels.

However, the two rows of suction holes to which vacuum can be admitted exclusively retain the leading edge of the blank on the counter roll. Adjustments only permit adaptation to different formats (sizes) or spacings between the leading edge of the blank and the window to be cut out. This cutting does not occur near the rows of suction holes, but in a cutting sector following in the circumferential direction. The cutting sector has a particularly hard surface and no suction holes. Therefore, waste cannot be transported in a controlled manner and via vacuum action to a predetermined location for discard.

European Patent No. 0 436 142 shows a knife roller in which foil knifes are chucked on a part of the body of the roll. The roll has a multitude of suction holes arranged in rows on its circumference, for temporarily retaining the material cut out from a letter envelope blank. Suction air control disks arranged on the face side on this part of the roll body enable the periodic feeding of controlled suction air to defined rows of suction holes, via longitudinal boreholes in the axle of the roll. It is thus possible to precisely seize and discharge cut out material with displacement in the circumferential direction of the knife roll. The suction air control disks rotating synchronously with the knife roll are adjustable only relative to the part of the body of the roll, and only have a distribution function in order to admit suction air to selected rows of suction holes. It is a drawback of this reference that the controlled suction air has to travel a long distance, from a suction air control valve through the longitudinal boreholes and the suction air control disks to its site of application on the suction holes on the circumference of the knife roll. This highly impairs chronologically exact seizing and discharging of the pieces of material cut out at high speeds of the roll. Since at most only two suction air control disks can be employed with this knife roll, the number of rows of suction holes to which suction air can be admitted in a controlled way with any one adjustment is limited to two as well, and so is the number of pieces of material transported with one turn (or rotation) of the roll.

Furthermore, an additional suction strip is needed that requires its own support, its own supply of suction air and its own drive. Due to the spatially restricted arrangement of the suction strip and the cutting foil, it is not possible to place window cutouts near the end of the letter envelope blank seized by the suction strip.

SUMMARY OF THE INVENTION

It is therefore an object of the invention to design a knife roll for the manufacture of letter envelopes and also other applications, to be applicable for as many varieties of use as possible.

It is another object of the invention to provide a knife roll that is also capable of safely and reliably discarding more than only one piece of waste per blank to be treated.

It is a further object of the invention to provide a knife roll that produces a window cutout near the leading transport edge of a letter envelope blank.

These and other objects of the invention are accomplished by a rotatable knife roll with at least one foil knife secured on a portion of the body of the roll and having a sharp and endless cutting edge closed within itself to cut out window openings. There are breakthroughs for suction apertures arranged within the cutting edge. There is at least one suction-air control valve arranged on the face side of the roll body. The valve is rotatable relative to this portion of the roll. The suction-air control valve has at least one suction-air-control channel and at least one fresh-air channel.

There are suction apertures for temporarily retaining a letter envelope blank over a suction and transport angle zone $\alpha$, and for retaining a piece of material cut out by the foil knife across a suction and transport angle zone $\beta$. The suction apertures are arranged in rows to which suction channels are allocated in the part of the roll body. The suction apertures are connected with the suction-air control channel and the fresh-air channel by the suction channels for conducting air. A 3/3-way valve is associated with the suction channel upstream of the suction-air control valve, with an open position for each suction and transport angle zones $\alpha$, $\beta$, and one common closing position for suction and transport angle zones $\alpha$ and $\beta$.

In the invention, the cutting roll is adjusted in the phase angle relative to the machine producing the letter envelopes so that the transport through the cutting station takes place in the cycle of the machine. Thereafter, through suitable selection and adjustment of the 3/3-way valve, a row of suction holes near the leading edge of the letter envelope blank is activated as the transporting suction row for transporting the blank for a suction and transport angle range α. The rows of suction holes for transporting cut pieces of material via the suction and transport angle range β are activated in a similar way.

The advantages of the invention are that irrespective of the size, number and position of window cutouts in a letter envelope blank, the correct rows of suction holes can be activated with corresponding selection and adjustment of the 3/3-way valves for transporting the letter envelope blank and the material cutouts via the suction and transport zones α and β.

The suction-air control valve has a stepped suction-air control channel with a first channel zone for suction and transport angle zone α, which is followed downstream by a first fresh-air channel, and a second channel zone for suction and transport angle zone β, which is followed downstream by a second fresh-air channel. The first channel zone and the first fresh-air channel are associated with a through-bore in the roll body. The second channel zone and the second fresh-air channel are associated with another through-bore in the roll body.

The suction-air control valve has two radially displaced, concentrically arranged suction-air control channels, with a fresh-air channel being arranged downstream of each of the control channels. Thus, it is possible to cut out windows near the leading edge of a letter envelope blank and, through activation of the correct rows of suction holes, to seize both the material cutouts and the leading edge of the letter envelope blank itself through the breakthroughs in the foil knife.

The 3/3-way valves are integrated in the roll body part and are formed by bores radially arranged in the roll body part. A suction channel feeds into the bore from one side, and an inner and an outer through-bore feed radially displaced into the bore from the other side. The bores are open toward the suction-air control valve. A rotatable control bush is arranged in the bore, which has interior chamber and is closed toward the cylinder circumference. The bush has bores arranged so that in one open position, the through-bore is connected with the interior chamber for conducting air. In another open position, the through-bore is connected via the control bush bores and the interior chamber with the suction channel. In the closed position, the suction channel is closed against the through-bore.

Depending on the number, size and position of the window cutouts in the blank, air-conducting connections can be established between the suction apertures of selected rows and the suction-air control valve, through selected open positions in the 3/3-way valves.

Preferably, there are additional breakthroughs in the foil cutter in front of a first cutting edge in one rotational direction of the knife roll. These breakthroughs seize the leading edge of a letter envelope blank having a window cutout near the leading edge.

Preferably, compressed air is admitted to at least one fresh-air channel, and there is preferably a suction-air control valve arranged on each of the two face sides of the roll body part.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views:

FIG. 7 is a sectional view of a 3/3-way valve in the open position for suction and transport angle zone β of material cutouts;

FIG. 8 is a top view of the 3/3-way valve in arrow direction VIII of FIG. 7;

FIG. 9 is a sectional view of a 3/3-way valve in the open position for the suction and transport angle zone a of letter envelope blanks;

FIG. 10 is a top view of the 3/3-way valve in arrow direction X of FIG. 9;

FIG. 11 is a sectional view of a 3/3-way valve in the closed position;

FIG. 12 is a top view of the 3/3-way valve in arrow direction XII of FIG. 11;

DETAILED DESCRIPTION OF THE PREFERRED EMBODIMENT

Figure 1:
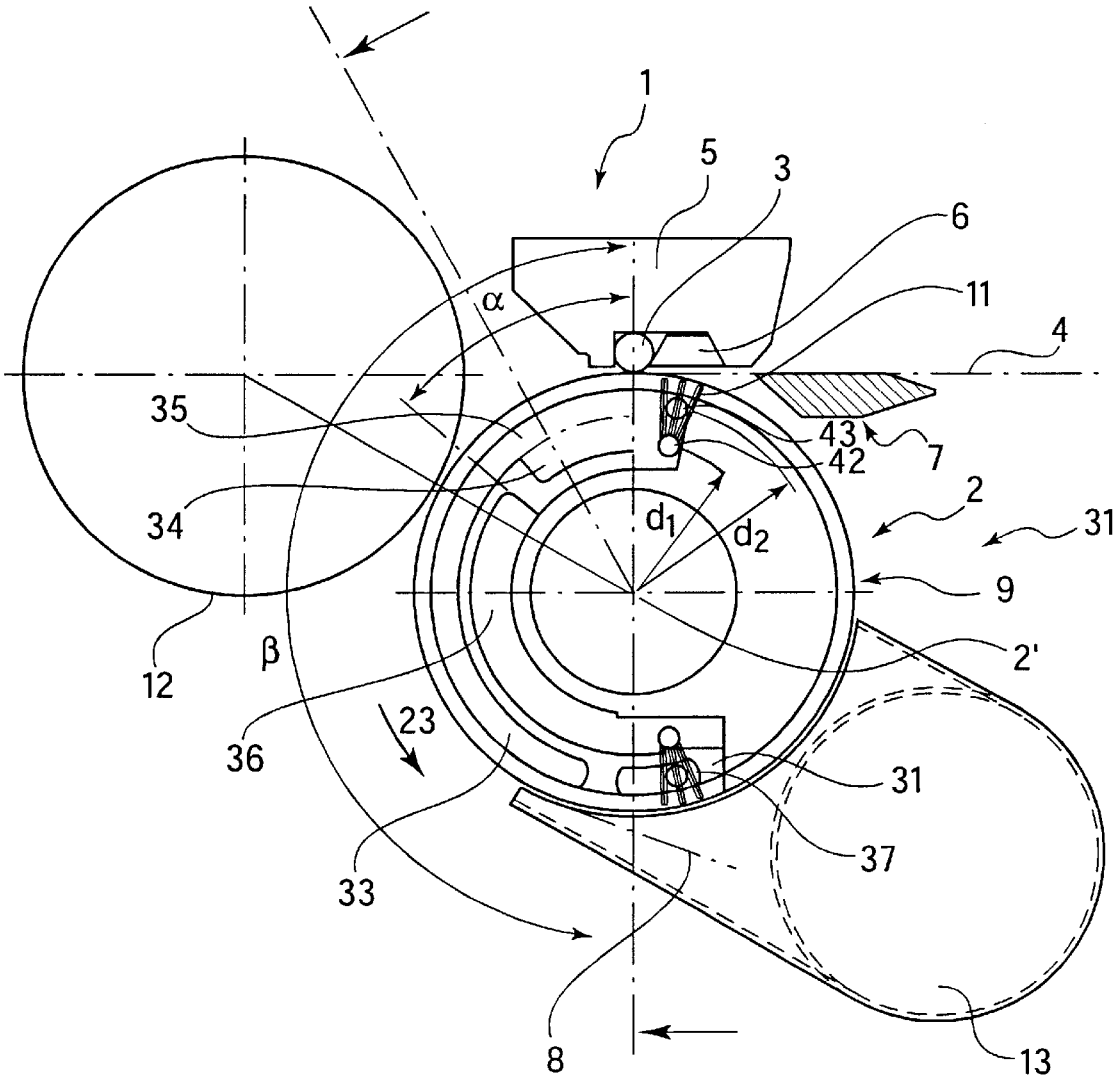
FIG. 1 is a schematic view of a cutting station with a knife roll.

FIG. 1 shows a cutting station 1 for window letter envelopes comprising a knife roll 2 and a stationary cutting bar 3 serving as the counter tool. A sequence of letter envelope blanks 4 is passed through and treated between the knife roll and counter tool. Cutting bar 3 is supported in a carrier 5, clamped with a strip 6, and is movable together with carrier 5 toward and away from knife roll 2.

Figure 2:
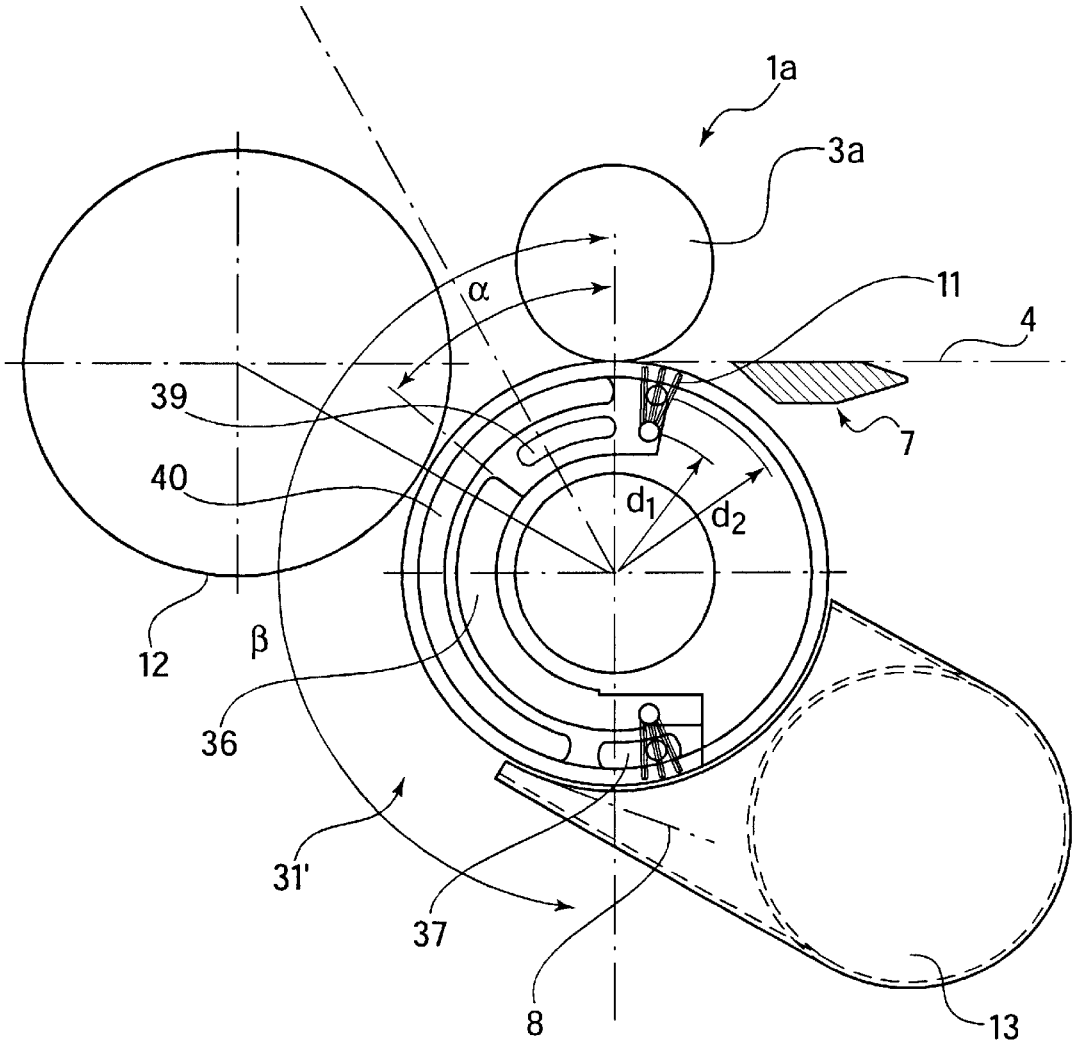
FIG. 2 is a schematic view of a cutting station with a knife roll and a modified suction air control system.

As shown in FIG. 2, cutting station 1*a* has a rotating counter roll 3*a* serving as the counter tool for knife roll 2. The sequence of letter envelope blanks 4 is guided through and treated between the two rolls. Counter roll 3*a* is supported in a carrier (not shown) and is jointly movable with the carrier against and away from knife roll 2.

Figure 3:
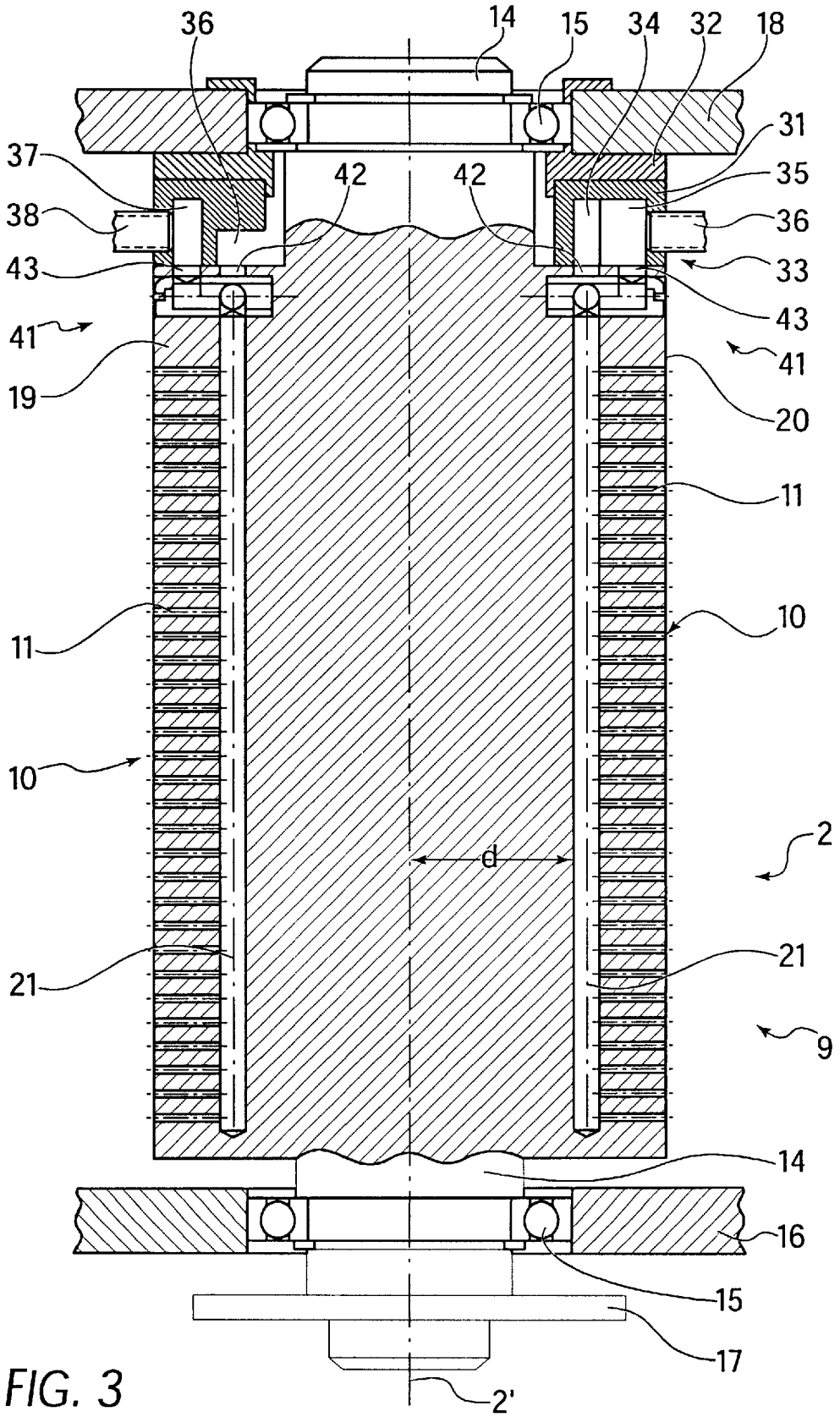
FIG. 3 is a sectional view of important components of the knife roll and its support.

Letter envelope blank 4 coming from a straight transport track 7 is seized by knife roll 2 and guided under the counter tool, cutting bar 3 or counter roll 3*a* along a circular track, whereby a window opening 8' is cut out. Knife roll 2, as shown in FIG. 3, has at its periphery 9 a multitude of suction apertures 11 arranged in rows 10 for receiving and transporting the seized letter envelope blank 4 and a window cutout or material piece 8 cut out from window 8'. Letter envelope blank 4 is retained on knife roll 2 via suction air over a suction and transport angle zone α, maintaining its preset phase position, and subsequently transferred with exact positioning to a discharging (or unloading) roll 12. Material piece 8 is held in the periphery of the window cutter by suction air and, after a suction and transport angle zone β, finally discharged into a suction hopper 13, blown off, if need be, via compressed air.

In cutting station 1 according to FIG. 1, material piece 8 cut out from window 8' is cut out and retained and then discharged into suction hopper 13 in the same way as in cutting station la according to FIG. 2.

Figure 4:
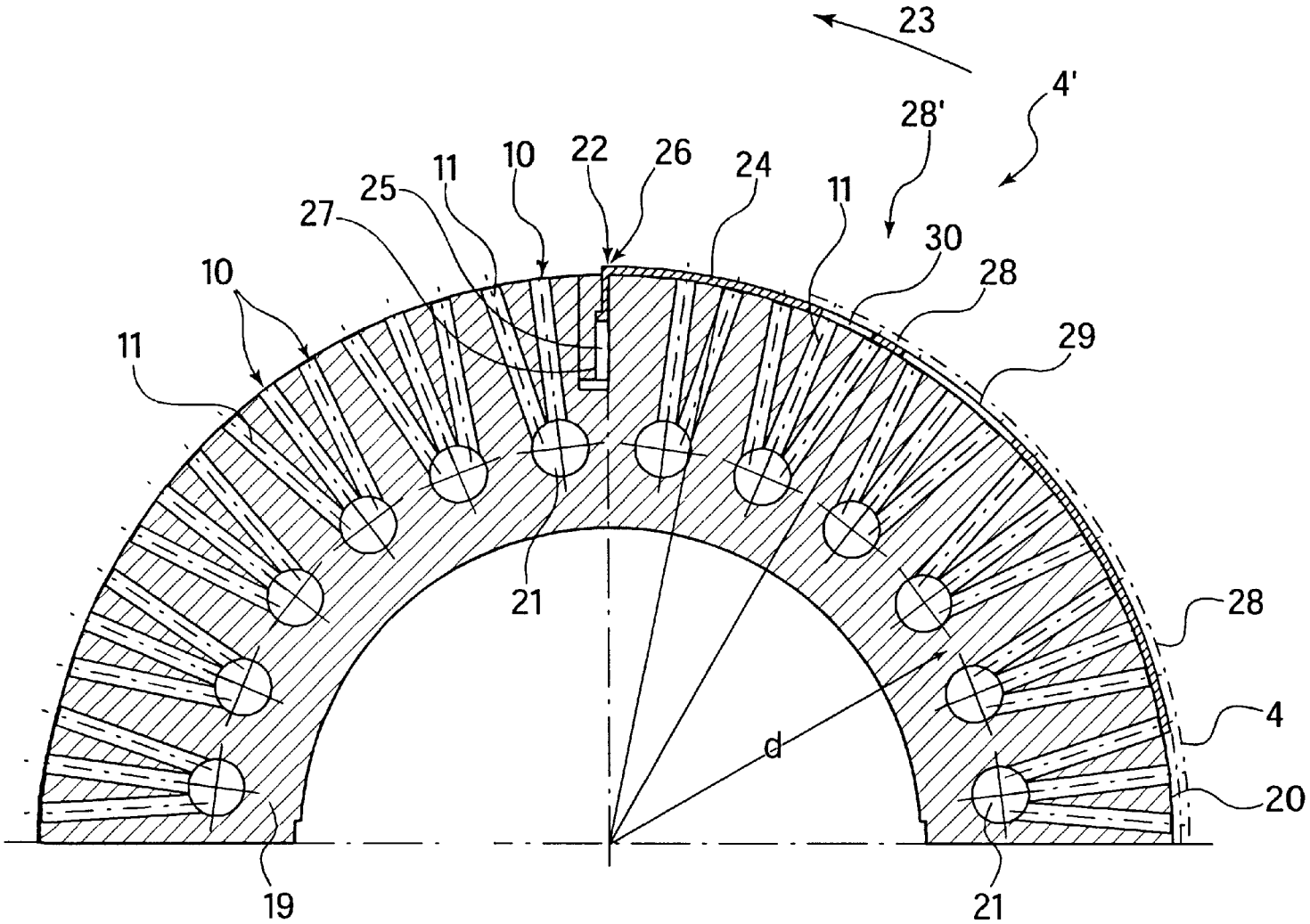
FIG. 4 is a partial sectional view of the roll body part of the knife roll with a chucked foil knife.

FIG. 3 shows a sectional view of knife roll 2 and its support as well as important components of knife roll 2 without the foil cutters and without the components for securing and clamping the foil cutters. Knife roll 2 comprises a carrier shaft 14, which is supported in machine frames 16, 18 by a plurality of ball bearings 15 and is driven by a toothed gear 17. A cylindrical roll body part 19 is secured between machine frames 16, 18 on carrier shaft 14. Suction apertures 11 are arranged on circumference 20 of carrier shaft 14 in rows 10. As shown in FIGS. 3 and 4, suction channels 21 are arranged with parallel axes in roll body part 19 with a spacing "d" from the axis of rotation 2' of knife roll 2. Suction channels 21 are communicatively connected with suction apertures 11 for conducting air. In this embodiment, each three rows 10 of suction apertures 11 are associated with a suction channel 21 except for the zone of a knife fastening 22, where two rows 10 are associated with a suction channel 21.

Figure 5:
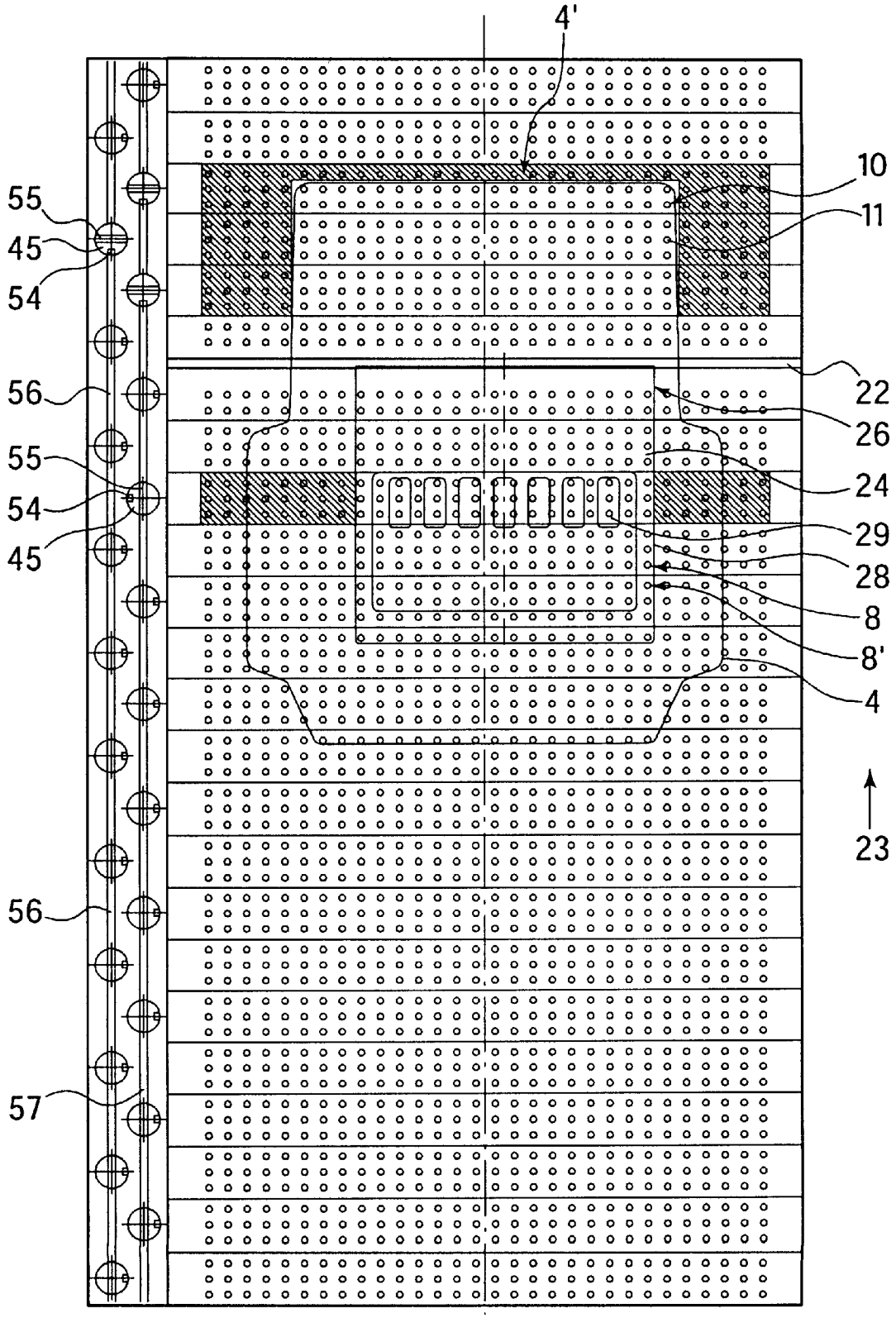
FIG. 5 is a layout of the roll body part with a foil knife and a letter envelope blank.
Figure 6:
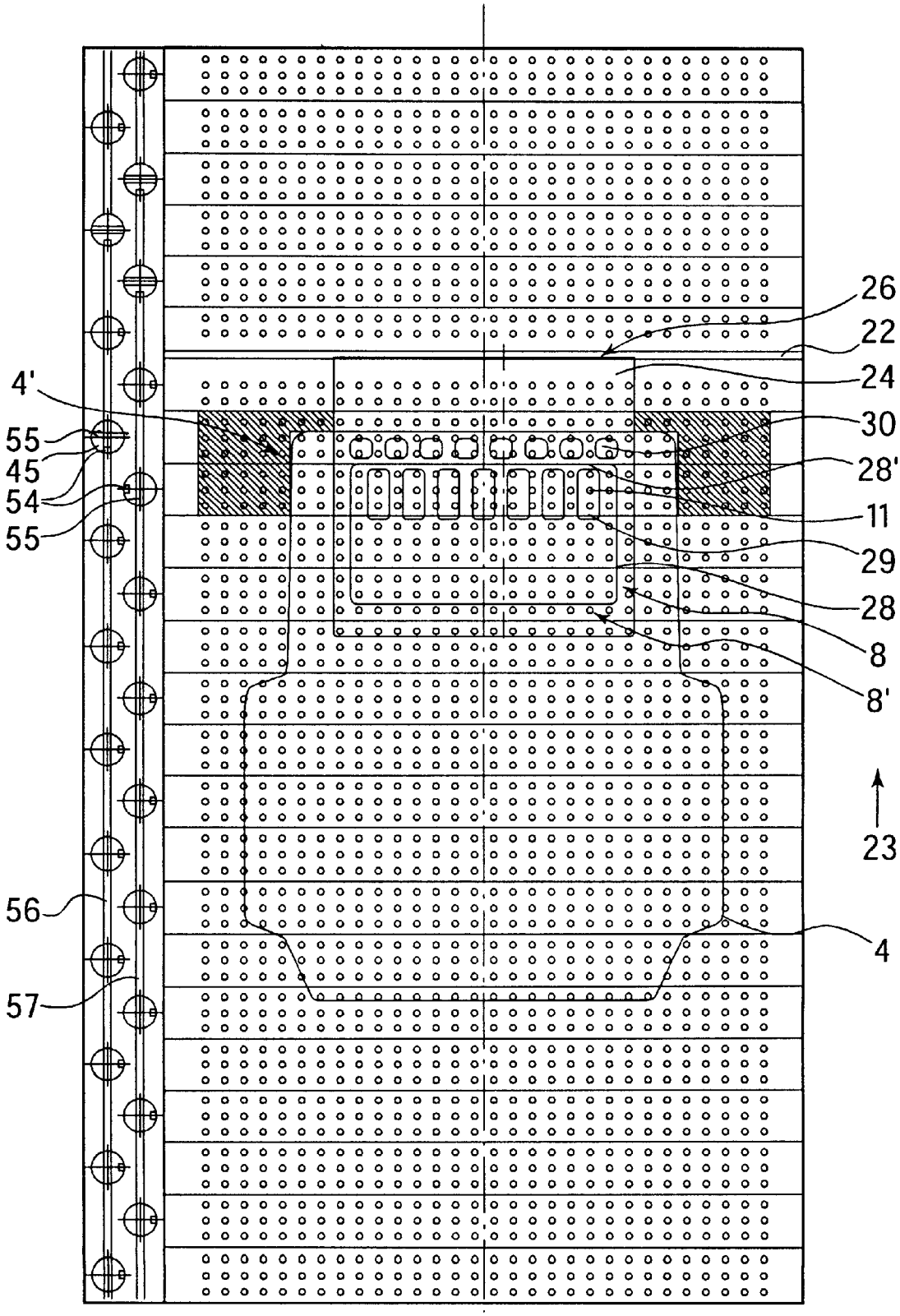
FIG. 6 is a layout of the roll body part with a modified foil knife and a letter envelope blank.

The ends 26 of foil cutters 24 leading in rotational direction 23 of the knife roll are fixed by knife fastening 22 and comprise an axially parallel recess 25 in roll body part 19. Ends 26 are fixed in recess 25 at an angle via clamping bar 27. Foil cutter 24 is held on circumference 20 of roll body part 19 by magnetic elements arranged on circumference 20 of roll body part 19, or by fixing the end trailing in the rotational direction 23 with a clamping device similar to knife fastening 22. Both types of fastening are part of the state of the art and not described herein in greater detail. FIGS. 4, 5 and 6 each show only one knife fastening 22. However, there also could be several fastenings in each cutting roll 2, particularly if the roll is designed for multiple application.

Employed as a window cutter, foil knife 24 has a closed cutting edge 28 corresponding with the form of a window opening 8'. In the surface of foil cutter 24 enclosed by cutting edge 28, there are breakthroughs 29 near a cutting edge 28' leading in rotational direction 23 for picking up the cut material piece 8 by suction. The suction apertures 11 feed into these breakthroughs.

FIGS. 4 and 6 show the breakthroughs 30 of foil cutter 24. These breakthroughs are arranged in rotational direction 23 ahead of cutting edge 28', with suction apertures 11 feeding into these breakthroughs as well. Breakthroughs 30 seize the leading end 4' of a letter envelope blank 4, in which a window opening 8' is cut out near the leading end 4'. FIG. 6 shows the normal case, whereby the leading end 4' of a letter envelope blank 4 is held directly on circumference 20 of roll body part 19 via suction apertures 11 arranged in rows 10.

As shown in FIG. 3, a suction-air control valve 31 is arranged on the face side of roll body part 19 and supported on machine frame wall 18 by a spacing and centering bush 32. Suction-air control valve 31 is arranged against roll body part 19 revolving in rotational direction 23. However, the valve can be adjusted in or against rotational direction 23. Furthermore, the control valve is designed not in the form of a closed rotating body, but in the form of a horseshoe for better accessibility and ease of maintenance. Suction-air control valve 31 has a suction-air control channel 33, from where suction air can be admitted to suction channels 21 via a suction and transport angle zone α or β as shown in FIGS. 1 and 3. Suction-air control channel 33, which is arranged centrically relative to rotation axis 2', is stepped, and has a first channel zone 34 for suction and transport angle zone α, and a second channel zone 35 for suction and transport angle zone β. A suction-air feed line 36 feeds into suction-air control channel 33 and is secured radially from the outside on suction-air control valve 31. Suction-air feed line 36 connects suction-air control channel 33 to a suction air source via feeding devices (not shown). Channel zones 34 and 35 each are followed downstream by a fresh-air channel 36 and 37, respectively, from where the vacuum in suction channels 21 and suction apertures 11 is canceled. Fresh-air channel 37 (shown in FIG. 3) is maintained under excess pressure and connected by a compressed-air feed line 38 with a compressed-air source (not shown). Through application of compressed air, the cut material pieces 8 are blown off and into suction hopper 13 at the end of suction and transport angle zone β.

FIG. 2 shows a slightly modified variation 31' of control head 31, in which there are two separate concentric suction-air control channels 39, 40 instead of the stepped suction-air control channel 33 with channel zones 34, 35. Control channels 39, 40 are followed downstream by fresh-air channels 36 and, respectively, 37.

Within end 19' of roll body part 19, which is disposed opposite suction-air control valve 31, a 3/3-way valve 41 is associated with each suction channel 21. An air-conducting connection can be selectively established via the valve between suction channel 21 and an inner and outer through-bore 42 and, respectively, 43 arranged on the face side. Through-bores 42 and 43, which are arranged radially displaced with a spacing $d_1$ and, respectively, $d_2$ from rotation axis 2', pass channel zone 34 and fresh-air channel 36, or channel zone 35 and fresh-air channel 37 with each cylinder rotation (or turn of the cylinder), and suction or fresh air is cyclically admitted into these zones and channels. Since "d" and "$d_1$" are equal in this embodiment, one suction channel 21 and one through-bore 42 associated therewith are axially aligned in each case.

In the variation with control head 31' (FIG. 2), the through-bores 42 and 43 according to FIG. 2 extend past the suction-air control channels 39 and 40, respectively, and the fresh-air channels 36 and, respectively, 37.

Figure 13:
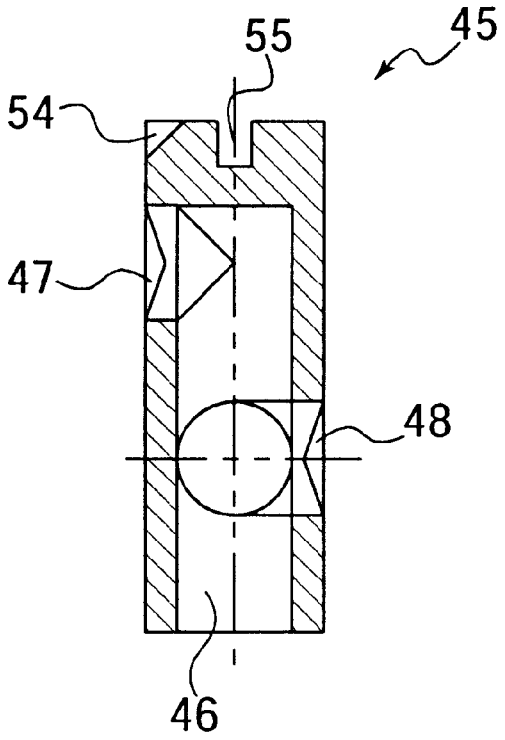
FIG. 13 is a sectional view of a control bush.
Figure 14:
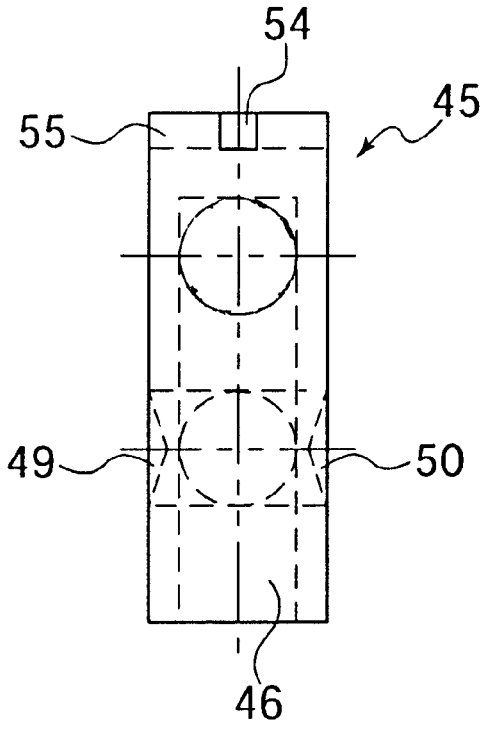
FIG. 14 is a side view of the control bush.

According to FIG. 3 or FIGS. 7 to 12, a 3/3-way valve 41 is formed by a radial dead-end borehole 44, into which suction channel 21 feeds from the side of the roll body, and the through-bores 42, 43 feed from the side of suction-air control valve 31, 31'. A rotatable control bush 45 is arranged in dead-end borehole 44 and is secured by sealing and holding elements (not shown). As shown in FIGS. 13 and 14, control bush 45 is a hollow cylinder, with an interior chamber 46 which is closed against circumference 20. A borehole 47 feeds into interior chamber 46 in accordance with spacing $d_2$. Opposite borehole 47, there is a borehole 48 in accordance with spacing d. Two opposite boreholes 49, 50 are arranged in control bush 45 in accordance with spacing d, $d_1$, at 90 degrees relative to bore 48.

FIGS. 7 to 12 show control bush 45 in different operating positions 51, 52 and 53. FIG. 7 shows the "open" position 51, in which an air-conducting connection is made from through-bore 43 via borehole 47, interior chamber 46, borehole 48 and suction channel 21 to suction bores 11 in a corresponding row 10. Through such a connection, channel zone 35 is connected for conduction of air in suction-air control valve 31, or in suction-air control valve 31', suction-air control channel 40 is connected with selected suction apertures 11 for conducting air.

FIG. 9 shows control bush 45 in the "open" position 52, in which an air-conducting connection is made between channel zone 34 via through-bore 42, borehole 49, interior chamber 46, borehole 50 and suction channel 21 and selected suction apertures 11.

FIG. 11 shows control bush 45 in the "closing" position 53, in which the respective suction channel 21 is shut off. The operational (or functional) positions 51, 52, 53 are freely selectable for each 3/3-way valve 41 and thus also for the associated suction channels 21 and the rows 10 of suction apertures 11. The operational positions of control bushes 45 are clearly indicated by the positional alignment of marking grooves 54, 55 provided on said bushes, in relation to circumferential marking grooves 56, 57 arranged on circumference 20 of roll body part 19, as shown in FIG. 6.

The mode of operation of the invention is described as follows: Knife roll 2 is first adjusted via adjusting elements in its phase position relative to the machine producing the letter envelopes, so that a window opening 8' to be produced is made in the desired site on letter envelope blank 4, the latter being supplied in the cycle of the machine in a regular phase position. Subsequently, one or several 3/3-way valves 41 are set to "open" position 52 depending on the selection and adjustment. Suction air is admitted in this way to selected rows 10 of suction apertures 11 from channel zone 34 and suction-air channel 39, for transporting letter envelope blank 4 across suction and transport angle zone a.

In a similar way, the desired rows 10 of suction apertures 11 are connected through open-position 51 with channel zone 35 and suction-air control channel 40 for conducting air. This accomplishes the purpose of transporting a cut material piece 8 to suction hopper 13 via suction and transport angle zone β.

To prevent suction errors, suction apertures 11 of rows 10 activated for transporting but not covered by foil cutter 24, or not required for transporting the letter envelope blank, are covered with adhesive foil, as shown in FIGS. 5 and 6. The surfaces of the adhesive foil are highlighted in FIGS. 5 and 6 by shading.

FIGS. 5 and 6 show that the invention, irrespective of the size of a letter envelope blank 4 as well as of the number, size and position of window openings 8' to be produced, always offers the possibility of ensuring a smooth and flawless transport of the letter envelope blanks 4 and the material pieces 8 cut out, through targeted activation of selected or required rows 10 of suction apertures 11. Furthermore, as shown in FIG. 6, it is possible to place window openings 8' near edge 4' of a letter envelope blank 4, such edge extending in transport direction 23.

Application of the technique disclosed by the invention is also possible with rolls having similar or other functions. Therefore, the invention is not limited to the concrete exemplified embodiment, but also further modifications and supplementations are possible without deviating front the basic idea of the invention.

What is claimed is:

1. A rotatable knife roll for cutting out window openings in envelopes, comprising:

a roll body having two face sides;

at least one foil knife disposed on a part of the roll body and having a sharp and endless cutting edge closed within itself;

a plurality of breakthroughs within said cutting edge;

at least one suction-air control valve arranged on at least one face side of the roll body and being rotatable relative to said roll body, said suction-air control valve comprising:

(a) at least one suction-air-control channel; and (b) at least one fresh-air channel;

a plurality of suction apertures disposed on the knife roll, some of said apertures being connected to the breakthroughs, for temporarily retaining a letter envelope blank over a suction and transport angle zone α, and for retaining a piece of material cut out by the foil knife across a suction and transport angle zone β, said suction apertures being arranged in rows to which said suction and fresh air channels are allocated, at least one suction channel connected with the suction apertures and with the suction air control channel and fresh air channel, for conducting air between the suction-air control channel and the fresh-air channel and the suction apertures; and a 3/3-way valve associated with the suction channel upstream of the suction-air control valve, said 3/3-way valve having an open position for each of suction and transport angle zones α and β, and one common closing position for suction and transport angle zones α and β.

2. The knife roll according to claim 1, wherein the suction-air control channel is stepped, with a first channel zone for suction and transport angle zone α, said first channel zone being followed downstream by one of the fresh-air channels, and with a second channel zone for suction and transport angle zone β, said second channel zone being followed downstream by another of the fresh-air channels and wherein the first and second channel zones and the fresh-air channels are associated with through-bores in the roll body.

3. The knife roll according to claim 1, wherein there are two suction air control channels that are radially displaced and concentrically arranged, with one of the fresh-air channels being arranged downstream of each of said control channels, one of said fresh-air channels and one suction control channel being associated with a through-bore and another suction-air control channel, and another of the fresh-air channels being associated with another through-bore.

4. The knife roll according to claim 3, further comprising additional breakthroughs in the foil knife in front of a first cutting edge in one rotational direction of the knife roll, for seizing the leading edge of a letter envelope blank having a window cutout placed near the leading edge.

5. The knife roll according to claim 3, further comprising at least one fresh-air channel connected with a source of compressed air.

6. The knife roll according to claim 1, wherein the 3/3-way valve is integrated in the roll body and is formed by a bore radially arranged in the roll body, and wherein the suction channel feeds into the bore from one side, and an inner and an outer through-bore feed radially displaced into said bore from the other side, said through bores being open toward the suction-air control valve, and further comprising a rotatable control bush arranged in the bore, said control bush having an interior chamber and being closed toward the cylinder circumference, and having control bush bores arranged so that for air conducting, in a first open position, the outer through-bore is connected via some of the control bush bores and the interior chamber with the suction channel, and in a second open position, the inner through-bore is connected via other of the control bush bores and the interior chamber with the suction channel, and that in the closing position, the suction channel is closed against the through-bores.

7. The knife roll according to claim 1, wherein air-conducting connections are established in a targeted way between the suction apertures of selected rows and the suction-air control valve, through selecting the open-positions in 3/3-way valves to correlate with the number and size of the window cutouts to be made.

8. The knife roll according to claim 1, wherein there are two suction air control valves, one suction-air control valve being arranged on each of the two face sides of the roll body.

* * * * *